US005890246A

United States Patent [19]

Davis

[11] Patent Number: 5,890,246

[45] Date of Patent: Apr. 6, 1999

[54] INFLATABLE PRE-NATAL SUPPORT MATTRESS

[76] Inventor: Richard P. Davis, 6942 FM1960 E., Humble, Tex. 77346

[21] Appl. No.: 44,270

[22] Filed: Mar. 19, 1998

[51] Int. Cl.[6] ..... A47C 27/08; A61G 7/00

[52] U.S. Cl. ..... 5/735; 5/706; 5/930

[58] Field of Search ..... 5/735, 930, 630, 5/706, 631, 644

[56] References Cited

U.S. PATENT DOCUMENTS

| | | | |
|---|---|---|---|
| D. 266,549 | 10/1982 | Lund, III | D6/601 |
| D. 267,299 | 12/1982 | Lund, III | D6/601 |
| D. 309,068 | 7/1990 | Jordan et al. | D6/601 |
| D. 326,790 | 6/1992 | Grigg | D6/601 |
| D. 368,524 | 4/1996 | Reedus | D24/183 |
| D. 368,824 | 4/1996 | Bonnaddio et al. | D6/601 |
| D. 384,536 | 10/1997 | Kraft | D6/601 |
| 3,678,926 | 7/1972 | Strittmatter | 128/94 |
| 4,021,872 | 5/1977 | Powell | 5/735 |
| 4,397,052 | 8/1983 | Lund, III | 5/632 |
| 4,411,035 | 10/1983 | Fenwick | 5/618 |
| 4,447,922 | 5/1984 | Brochu | 5/636 |
| 4,523,588 | 6/1985 | Dolsky | 5/636 |
| 5,012,539 | 5/1991 | Grigg | 5/644 |
| 5,029,351 | 7/1991 | Weber | 5/655 |
| 5,133,098 | 7/1992 | Weber | 5/655 |
| 5,148,564 | 9/1992 | Reder | 5/636 |
| 5,185,897 | 2/1993 | Van Laanen | 5/735 |
| 5,369,824 | 12/1994 | Powell | 5/930 |
| 5,425,147 | 6/1995 | Supplee et al. | 5/735 |
| 5,471,690 | 12/1995 | McNeil | 5/644 |
| 5,537,703 | 7/1996 | Launder et al. | 5/636 |
| 5,642,543 | 7/1997 | Huntley | 5/640 |
| 5,644,810 | 7/1997 | Kato | 5/645 |
| 5,661,861 | 9/1997 | Matthews | 5/633 |
| 5,664,271 | 9/1997 | Bellavance | 5/632 |
| 5,708,999 | 1/1998 | Priolo et al. | 5/644 |
| 5,720,061 | 2/1998 | Giori et al. | 5/735 |

FOREIGN PATENT DOCUMENTS

| | | | |
|---|---|---|---|
| 2826074 | 12/1979 | Germany | 5/631 |

*Primary Examiner*—Alex Grosz

*Attorney, Agent, or Firm*—Robert C. Curfiss; Bracewell & Patterson

[57] ABSTRACT

A personal support device adapted for permitting a pregnant woman to lie on her stomach or abdomen even during the third trimester of pregnancy is formed of an inflatable mattress with an isolated section defined by a cylindrical wall. A portion of the outer membranae of the mattress extends into the isolated section to form a cavity for receiving and supporting the abdomen. Clearance holes in the cylindrical wall permit the isolated section to breathe, thereby permitting the cavity to expand and contract to maximize both the support and the comfort of the woman.

1 Claim, 2 Drawing Sheets

INFLATABLE PRE-NATAL SUPPORT MATTRESS

BACKGROUND OF THE INVENTION

1. Field of the Invention

The subject invention is generally related to devices for providing support during pregnancy and is specifically directed to an inflatable device for providing back support permitting a pregnant woman to lie on her stomach without back strain or discomfort.

2. Discussion of the Prior Art

There are many devices adapted for assisting in the comfort of women during pregnancy, particularly during the third trimester when prenatal discomfort is at its peak. For example, U.S. Pat. No. Des. 266,549, entitled: "Prenatal Support Pillow", issued to R. G. Lund, III, on Oct. 19, 1982 shows a device for providing lateral support permitting the pregnant woman to lie more comfortably on her side or in a lateral position. U.S. Pat. No. 4,397,057, also entitled: "Prenatal Support Pillow", issued to R. G. Lund, III, on Aug. 9, 1983 discloses a lateral support device for permitting lateral prenatal support while the pregnant woman lies on her side. U.S. Pat. No. 5,664,271, entitled: "Support Pillow Assembly", issued to: J. M. Bellavance on Sep. 9, 1997 shows a support pillow for cushioning the body of a person while the person is lying on her side on a mattress and includes an abdominal support pillow adapted to partially underlie the person's abdomen and a leg support pillow adapted to be positioned between the person's legs. The device is particularly useful as a prenatal support system for increasing comfort while lying in a lateral position.

U.S. Pat. No. 4,411,035, entitled: "Maternity Care Bed", issued to L. Fenwick on Oct. 25, 1983 discloses an adjustable bed having three separate platforms for supporting the body of a pregnant woman while on her back during the final stages of pregnancy and through delivery.

All of these devices are useful in providing support and reducing strain and discomfort during pregnancy. However, all require that the pregnant woman lie in a lateral position or on her back. There are not any known devices which permit a pregnant woman to lie on her stomach or abdomen during pregnancy without discomfort or back strain. This is a significant problem for women who sleep while lying on their stomach, or who have back problems making lateral reclining positions difficult. It is a particularly acute problem for women who are confined to bed rest during the latter stages of pregnancy and are forced to stay on their back for long periods at a time. Many women would prefer to be able to rest or sleep while lying on their stomach or abdomen during the latter stages of pregnancy, but cannot because the known support devices only provide back or lateral support.

SUMMARY OF THE INVENTION

The subject invention is a prenatal support device providing support for a pregnant woman lying on her abdomen or stomach, and is particularly useful during the third trimester of pregnancy when discomfort and strain is at a peak. In the preferred embodiment of the invention, a inflatable mattress is designed to fit on a standard single or twin bed box spring or support frame. A central portion of the mattress includes an indentation or dish, providing a cavity large enough to define a pocket for the child being carried by the pregnant women. When she lies on her stomach, the child is cradled in the "pocket", permitting the expectant mother to lie on her stomach in comfort, with a minimum of strain on her back. The invention permits the pregnant woman to sleep or rest while lying on her stomach. The cradling effect of the pocket also reduces strain and discomfort on the abdomen.

In the preferred embodiment, the prenatal support device of the subject invention is an inflatable mattress adapted to be placed on a standard mattress surface, or on the floor. This is particularly useful during travel. The inflatable device is also valuable during medical emergency situations, permitting medical support personnel to place a pregnant woman on her stomach in order to perform certain medical procedures, while assuring the comfort of the patient and minimizing back strain. Another advantage of the inflatable device is the ability to adjust firmness to personal comfort.

It is, therefore, and object and feature of the subject invention to provide a prenatal support system adapted for permitting a pregnant woman to lie on her stomach or abdomen with comfort and a minimum of back strain.

It is a further object and feature of the subject invention to provide a prenatal support mattress with a pocket cavity for receiving and supporting the unborn child and cradling it to support the abdomen of a pregnant woman while lying on her stomach.

It is yet another object and feature of the subject invention to provide a prenatal support system for supporting a pregnant woman on her stomach during medical procedures.

It is an additional object and feature of the subject invention to provide a prenatal support system permitting a pregnant woman to lie on her stomach or abdomen while traveling or at a remote medical treatment action.

Other objects and features of the invention will be readily apparent from the drawings and the detailed description of the preferred embodiments.

DETAILED DESCRIPTION OF THE PREFERRED EMBODIMENTS

Figure 1:
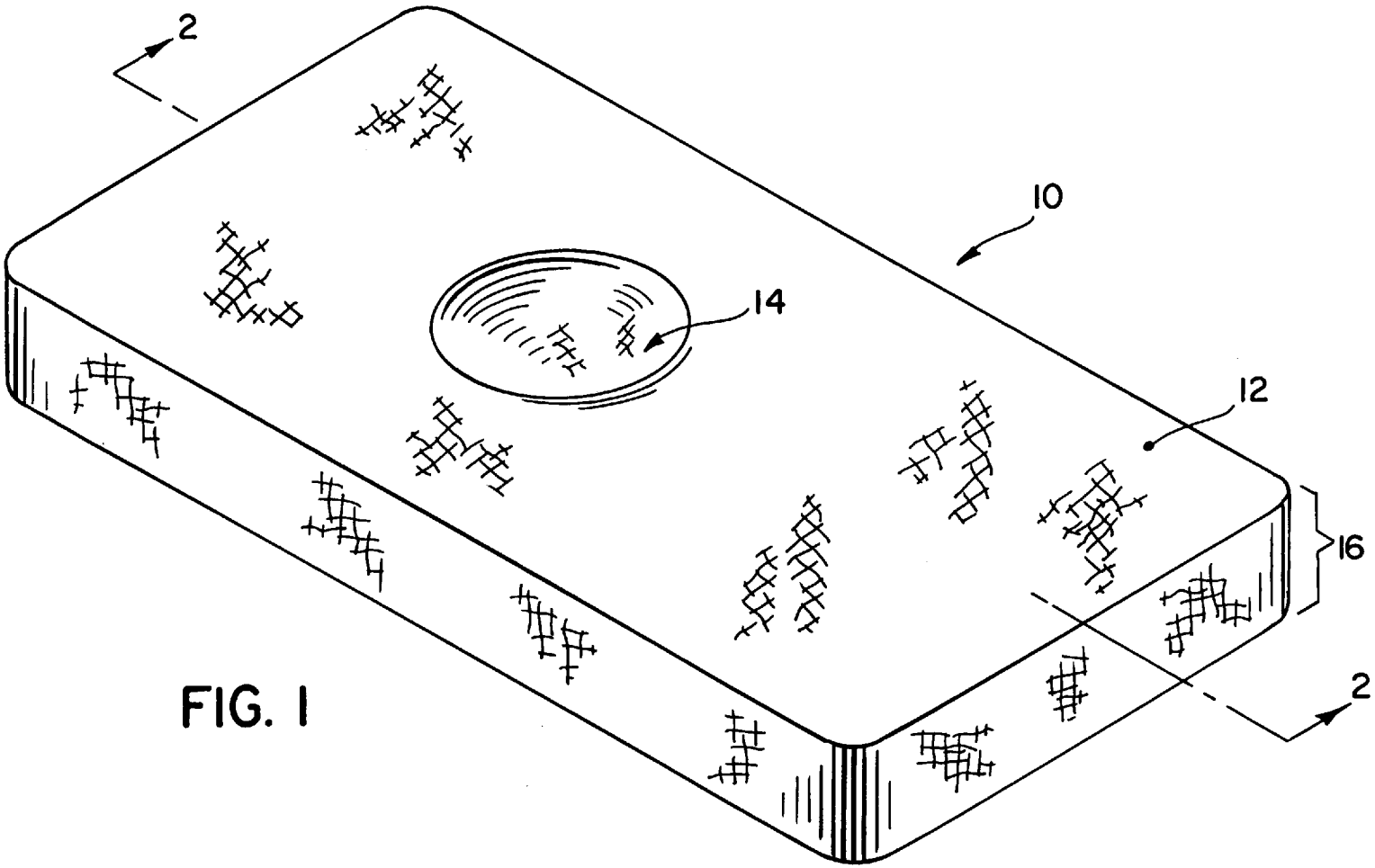
FIG. 1 is a perspective view of a mattress designed to fit on a twin bed frame, showing the prenatal support cavity.

The prenatal support system of the subject invention provides a support device permitting a pregnant woman to lie on her stomach or abdomen. As shown in FIG. 1, a mattress 10 includes an upper surface 12. A dished out portion or cavity 14 is provided approximately in the center of the surface 12. The cavity is sufficiently large to accept the enlarged abdomen of a pregnant woman during the third trimester of pregnancy. In the preferred embodiment of the invention the mattress 10 is dimensioned to fit an a twin bed size box spring or support frame. The mattress is about ten inches thick along the thickness dimension 16, with the cavity having a maximum depth of about eight inches, permitting mattress fill to be placed beneath the cavity, as at 18 (see FIG. 2). Of course, the actual dimensions may vary, depending on requirement for comfort.

Figure 2:
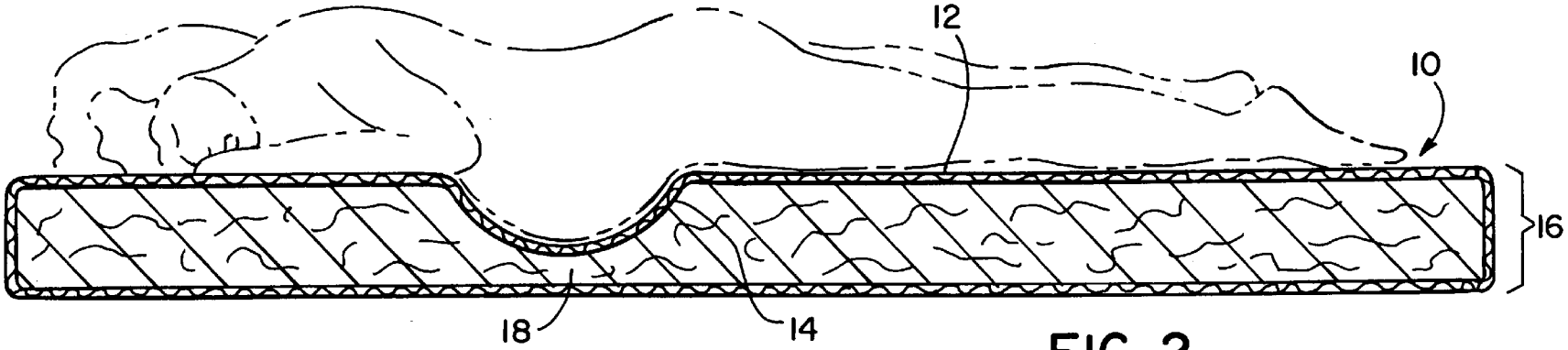
FIG. 2 is a longitudinal cross-section of the mattress of FIG. 1, with a pregnant woman shown in phantom lying on her abdomen with the unborn child being received in and cradled by the support mattress pocket.

As shown in FIG. 2, when a pregnant woman lies on her stomach on the mattress her enlarged abdomen will fit into the clearance area provided by the cavity 14. Her abdomen is actually cradled in the cavity, while her spine is in its natural curvature, providing a maximum of comfort and substantially reducing back strain. This permits the woman to sleep or rest on her stomach, even during the final trimester of the pregnancy. It also permits certain medical procedures to be performed while the woman is on her stomach with a minimum of discomfort. The invention is particularly useful for women who cannot sleep well on their side or back, or for women who are confined to bed rest for long periods of time.

Figure 3:
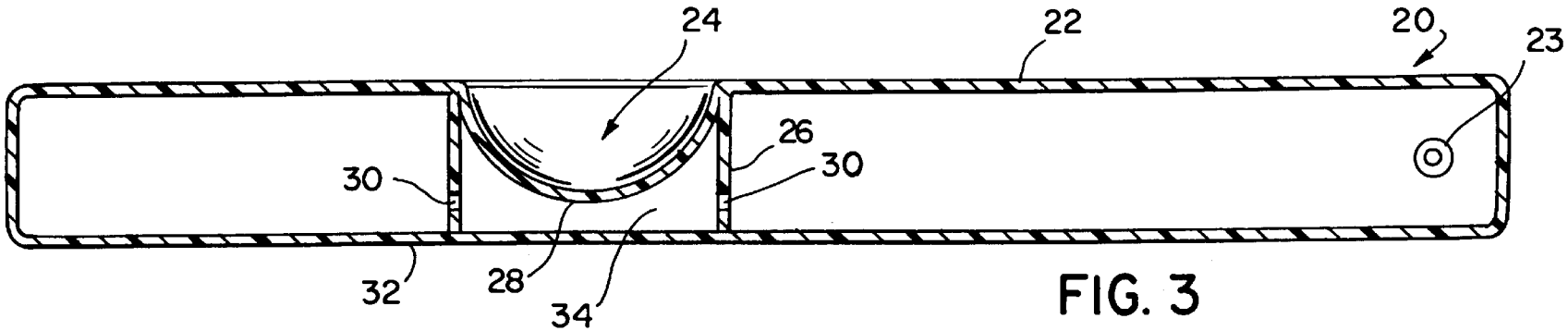
FIG. 3 is a longitudinal cross-section of an inflatable mattress incorporating the teachings of the subject invention.

A portable, inflatable embodiment of the invention is shown in FIG. 3. This is particularly useful for travel, or for EMT teams or the like, where it may be desirable to place a pregnant woman on her stomach during emergency medical treatment. The mattress 20 is made of a typical inflatable membrane 22 forming a closed envelope and may be manually or mechanically inflated and deflated through valve 23. A separate cylindrical section or cavity 24 is defined by a cylindrical or truncated conical membrane wall 26 extending through the mattress, A portion 28 of the upper wall of the membrane 22 is positioned within the cylindrical section and defines a concave cavity formed in the membrane when inflated, as shown at 24, and adapted for defining an abdomen receiving and supporting cavity in the mattress. Clearance holes 30 are provided around the perimeter of the wall 26 beneath the bottom wall 28 and the lower wall 32 of the membrane to permit a cushion of air to be provided under the cavity 24, as at 34. The woman lies on the mattress in the same manner as shown in FIG. 2.

One advantage of the inflatable mattress is the ability to adjust the firmness of the mattress to comfort. Another advantage of the inflatable mattress is that it may be deflated and stored, making it easy to transport for travel or for emergency medical use.

The subject invention provides a useful prenatal support device permitting a pregnant woman to lie on her stomach or abdomen even during the third trimester of pregnancy with a minimum of back strain. While certain features and embodiments of the invention are shown and described in detail herein, it will be understood that the invention encompasses all of the improvements, enhancements and modifications within the scope and spirit of the following claims.

What is claimed is:

1. An inflatable maternity mattress for supporting the expanding abdomen of a pregnant woman, the mattress comprising:

a. an external inflatable membrane forming a closed envelope;

b. a valve for introducing and releasing air from the interior of the envelope whereby the envelope may be inflated to form a mattress;

c. a wall within the membrane for defining a separate cylindrical section, said wall for isolating the cylindrical section from the remainder of the membrane to form an inner mattress section when the membrane is inflated;

d. a portion of said membrane material positioned within the cylindrical section and defining a concave cavity formed in the membrane when inflated, and adapted for defining an abdomen receiving and supporting cavity in the mattress;

e. clearance holes in the cylindrical section wall adapted for permitting communication between the cylindrical section and the remainder of the envelope for permitting air to escape from the cylindrical section and the remainder of the envelope fro permitting air to escape from the cylindrical section into the mattress section by the abdomen, whereby the cavity automatically adjust to the size and shape of the abdomen of the pregnant woman.

* * * * *